US006230352B1

(12) United States Patent
Kasem

(10) Patent No.: US 6,230,352 B1
(45) Date of Patent: May 15, 2001

(54) SAFETY SHEET FOR CRIB

(76) Inventor: Jean Kasem, 138 N. Mapleton Dr., Los Angeles, CA (US) 90077

( * ) Notice: Subject to any disclaimer, the term of this patent is extended or adjusted under 35 U.S.C. 154(b) by 0 days.

(21) Appl. No.: 09/231,941

(22) Filed: Jan. 14, 1999

(51) Int. Cl.[7] ..... A47C 17/00

(52) U.S. Cl. ..... 5/737; 5/722; 5/738; 5/497; 5/499

(58) Field of Search ..... 5/692, 722, 738, 5/482, 495, 496, 497, 499, 902, 922, 923, 99.1, 93.1, 737, 490; D6/596, 601, 602, 606; 297/219.1, 223, 229

(56) References Cited

U.S. PATENT DOCUMENTS

| | | | | |
|---|---|---|---|---|
| D. 355,077 | * | 2/1995 | Tegner | D6/596 X |
| 2,123,667 | * | 7/1938 | Trubitz | 297/229 |
| 2,144,646 | * | 1/1939 | Zalkind | 52/630 |
| 3,298,040 | * | 1/1967 | Radel | 5/12.1 |
| 3,443,294 | * | 5/1969 | George | 5/496 |
| 3,583,009 | * | 6/1971 | Smith | 5/499 |
| 3,659,297 | * | 5/1972 | Schutz | 5/722 X |
| 3,848,281 | * | 11/1974 | Mathews | 5/902 X |
| 3,890,658 | * | 6/1975 | Petersilie | 5/722 X |
| 5,491,851 | * | 2/1996 | Alonso | 5/722 X |
| 5,765,502 | * | 6/1998 | Haugh | 5/722 X |
| 6,018,831 | * | 2/2000 | Loomos | 5/490 X |
| 6,026,525 | * | 2/2000 | Davis | 5/722 X |

* cited by examiner

*Primary Examiner*—Terry Lee Melius
*Assistant Examiner*—James M Hewitt
(74) *Attorney, Agent, or Firm*—Blakely, Sokoloff, Taylor & Zafman LLP

(57) ABSTRACT

A safety crib sheet and a safety crib sheet mattress assembly to reduce the risk of infant smothering and strangulation. Pieces of material are sewn such that the resulting sheet can not be installed or dislodged from the mattress without substantially destroying the sheet or deforming the mattress. In one embodiment, a mattress is formed in two subsections coupled along a fold line. The mattress must be folded in half along the fold line to install or dislodge the sheet. In another embodiment, a conventional crib mattress is used with a sheet that covers a substantial portion of the underside of the mattress and is sufficiently unelastic that the mattress must be significantly bent at least at the corners to permit the sheet to be installed or dislodged.

17 Claims, 2 Drawing Sheets

SAFETY SHEET FOR CRIB

BACKGROUND OF THE INVENTION (1) Field of the Invention

The invention relates to a crib sheet. More specifically, the invention relates to a sheet that reduces the risk of infant smotherings.

(2) Background

Conventional sheets can be broken out into two broad categories, fitted and unfitted. Unfitted sheets are substantially flat pieces of material with a dimension that permits them to be tucked in to encompass a top surface and sides of a mattress with sufficient material on which the mattress rests to retain the sheet in place. Such sheets are easily dislodged from a mattress, as it is only the weight of the mattress that retains the sheet thereon. Fitted sheets are designed for a particular size of mattress and typically have elastic gathers at the corners. The corners of the mattress can then be seated in these elastic gather formed corners of the fitted sheet. The elastic helps retain the sheet on the mattress. However, it is typically suffciently elastic that pulling on the sheet will cause the elastic to stretch and the sheet is thereby dislodgeable from the mattress without significantly bending or deforming the mattress. Crib sheets fall into the same broad categories but are, of course, smaller in size than conventional sheets. Both kinds of sheets when used in cribs have been found to be subject to accidental dislodgment and have resulted in a number of infant suffocations.

BRIEF SUMMARY OF THE INVENTION

A safety crib sheet and a safety crib sheet mattress assembly to reduce the risk of infant smothering is disclosed. Pieces of material are sewn such that the resulting sheet can not be installed or dislodged from the mattress without substantially deforming the mattress. In one embodiment, a mattress is formed in two subsections coupled along a fold line. The mattress must be folded in half along the fold line to install or dislodge the sheet. In another embodiment, a conventional crib mattress is used with a sheet that covers a substantial portion of the underside of the mattress and is sufficiently unelastic that the mattress must be significantly bent at least at the corners to permit the sheet to be installed or dislodged.

DETAILED DESCRIPTION OF THE INVENTION

Figure 1:
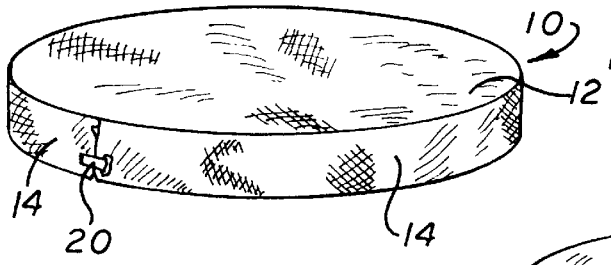
FIG. 1 is a perspective view of a safety crib sheet of one embodiment of the invention installed on a mattress.
Figure 2:
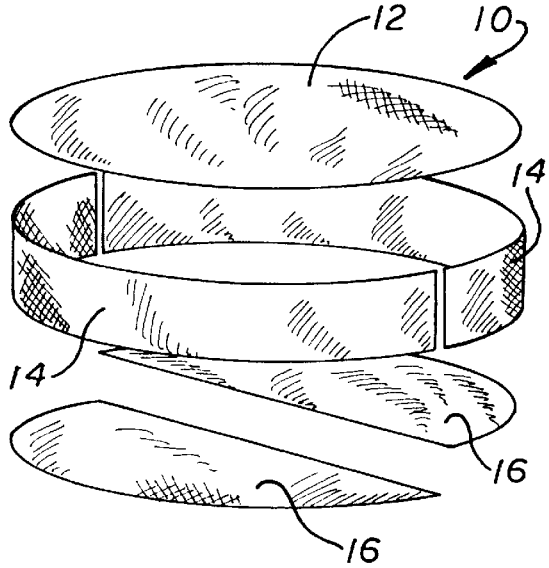
FIG. 2 is an exploded view of the sheet of FIG. 1.

FIG. 1 is a perspective view of a safety crib sheet of one embodiment of the invention installed on a mattress. A top panel 12 is sewn to side panel 14. An optional additional closure means 20 which may be hook and loop material, snaps, or any other conventional fastening device may be provided. FIG. 2 is an exploded view of the sheet of FIG. 1. Sheet 10 includes a plurality of fabric pieces. Top panel 12 in one embodiment is circular. However, an elliptical top panel or even a rectangular top panel are within the scope and contemplation of the invention. One or more side panels 14 are sewn about the periphery of top panel 12. Bottom panels 16 are then coupled to the side panels such that the composite of the side panels, bottom panels and top panel in one embodiment define a cylinder. Bottom panel 16 may be semi-circles or merely arcuate pieces having a radius of curvature the same as top panel 12. In an embodiment having a rectangular top panel, the bottom panels could be rectangular or could have a curve in the side adjacent to the other bottom panel.

Figure 3:
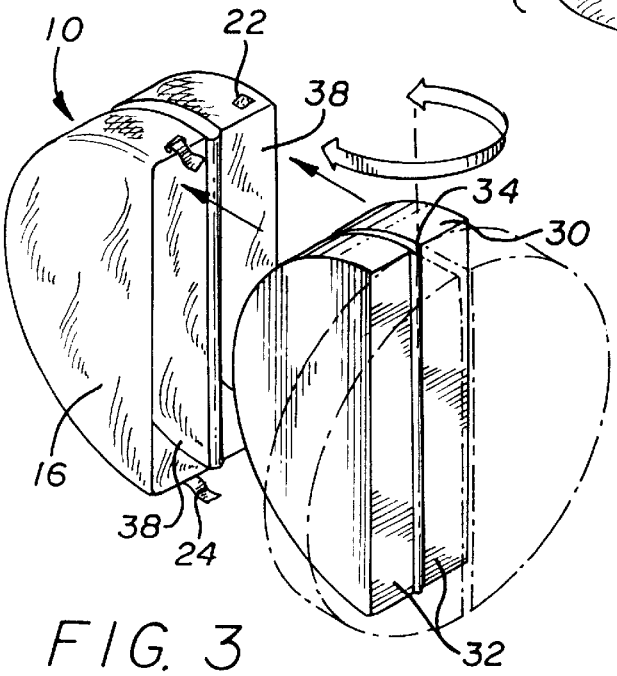
FIG. 3 shows installation of the sheet of FIG. 1 onto a mattress.
Figure 4:
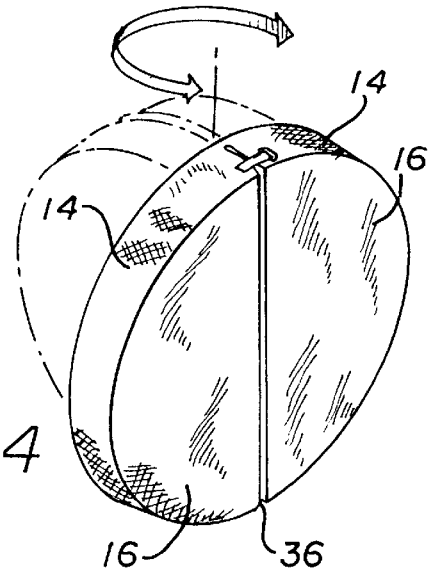
FIG. 4 shows the mattress returned to a use orientation where both subsections are flat and reside within the same plane.

FIG. 3 shows installation of the sheet onto a mattress. Mattress 30 includes two three dimensional subsections 32. Here each subsection 32 is a half cylinder. Subsections 32 are connected along foldline 34. Each subsection 32 is manufactured in the manner of a conventional mattress. Folding along foldline 34 the mattress takes on a half cylindrical shape with both halves of the top surface adjacent to one another. The folded mattress is inserted into the pair of envelopes 38 formed by the sheet. In one embodiment, the dimension of bottom panel 16 is selected such that each subsection is substantially enveloped within the sheet, e.g. the bottom surface of the mattress is substantially entirely covered by the sheet. In other embodiments, more of the bottom surface is left exposed. As shown in FIG. 4, the mattress can then be returned to a use orientation where both subsections are flat and the top surface is substantially planar. The gap 36 between bottom panel 16 may vary in width. However, the sheet is substantially non-elastic or has insufficient elasticity to permit the sheet to be non-destructively disengaged from the mattress without the mattress first being deformed, e.g. folded, into a non-use orientation. Accordingly, the risk of unintentional sheet disengagement is substantially reduced.

Figure 5:
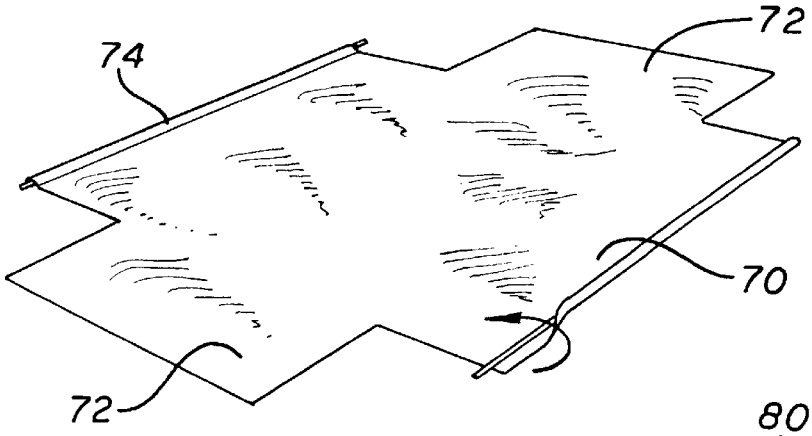
FIG. 5 shows a blank from which second embodiment of the invention may be assembled.
Figure 6:
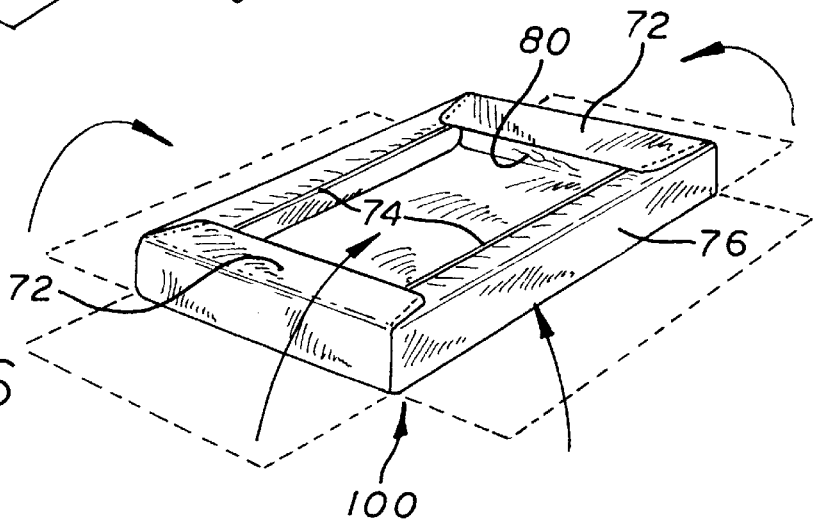
FIG. 6 shows assembly of a safety crib sheet from the blank of FIG. 5.

FIG. 5 shows a blank that may be assembled into a second embodiment of the invention. In this embodiment, a material sheet has a substantially rectangular central region 70 and has extending therefrom along its short sides two flaps 72. Elastic gathers 74 are attached to the central region 70 along at least a portion of its long sides. FIG. 6 shows assembly of a safety crib sheet from the blank of FIG. 5. The sides of the blank are folded and sewn to define a rectangular volume with an opening permitting access to the rectangular volume. Each flap 72 being folded and sewn to the central region 70 defines a pocket 80 at either end of the rectangular volume. The elastic gathers 74 have a maximum elasticity or stretch distance. The depth of pocket 80 is chosen to be greater than the maximum stretch distance for the elastic gathers 74. Thus, when a mattress is installed within the rectangular volume there is insufficient elasticity in the gathers to permit the pockets to become disengaged from the end of the mattress (or any corner of the mattress) without first destroying the sheet or deforming the mattress.

Figure 7:
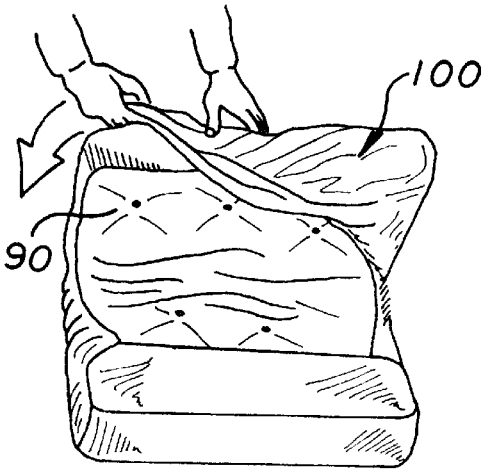
FIG. 7 shows a view of a mattress having the sheet of FIG. 6 installed thereon.

FIG. 7 shows a view of a mattress having the sheet of FIG. 6 installed thereon. Mattress 90 is deformed in this case bent about its center to permit the sheet 100 to be installed thereon. It is within the scope and contemplation of the invention that it may not be necessary to deform the mattress about its center to install the sheet. However a significant amount of deformation should be required to install or remove the sheet to insure that once installed the sheet will remain in place and not subject to accidental disengagement.

Figure 8:
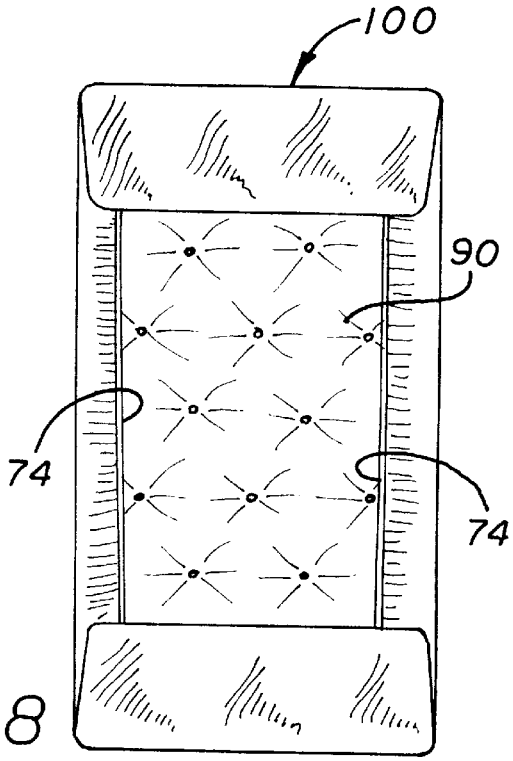
FIG. 8 shows a conventional crib mattress with the sheet of FIG. 6 installed thereon.

FIG. 8 shows the mattress 90 with the sheet 100 installed thereon. As shown, the bottom of mattress 90 is exposed through the opening in sheet 100, however, a significant portion of the surface area the bottom of mattress 90 is covered by sheet 100 while installed. In one embodiment, the coverage of the bottom of the mattress exceeds 40% of the surface area of the bottom of the mattress. The greater the area covered the more deformation is likely to be required to install or remove the sheet. This of course is subject to the elasticity of the gathers 74. It is within the scope and comtemplation of the invention to have elastic gathers on the short sides or on both the short and long sides, but the maximum elasticity should still be such that no corner can be disengaged from the sheet without deforming the mattress. In another embodiment, the elastic gathers are eliminated entirely.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. A crib sheet comprising:

a non-polygonal panel of material;

an elongated panel of material having a first end and a second end, the elongated panel having a top edge coupled along a perimeter of the non-polygonal panel of material;

a first and a second arcuate piece of material each having an arcing edge with a radius of curvature approximately equal to a radius of curvature of a corresponding arc of the non-polygonal panel and coupled to a bottom edge of the elongated panel along the arcing edge.

2. The crib sheet of claim 1 wherein the first arcuate piece and the second arcuate piece are each approximately semicircular, the first arcuate piece having a straight edge substantially parallel to a straight edge of the second arcuate piece.

3. The crib sheet of claim 1 wherein the non-polygonal panel of material is substantially circular.

4. The crib sheet of claim 1 wherein all material is substantially non-elastic.

5. The crib sheet of claim 1 wherein the non-polygonal panel is substantially elliptical.

6. An apparatus comprising:

a mattress having a top, a side wall, and a bottom, the mattress being one that has a fabric case filled with resilient material, a sheet configured to substantially envelop the mattress such that substantial folding of the mattress is required to install the sheet and substantial folding of the mattress is required to remove the sheet from the mattress.

7. The apparatus of claim 6 wherein the sheet comprises one or more fabric pieces sewn to cover the top, the side wall, and a substantial portion of the bottom of the mattress, and wherein the mattress is a crib mattress.

8. The apparatus of claim 7 wherein the sheet is formed from one unitary piece of fabric.

9. The apparatus of claim 8 wherein the unitary piece of fabric has a substantially rectangular central area having two long sides and two short sides and a rectangular flap extending from each of the short sides, a long dimension of the flap being shorter than a short side of the central area.

10. The apparatus of claim 9 further comprising an elastic gather coupled along a portion of each long dimension of the central area, the elastic gathers having a maximum elasticity and wherein the flap is sewn to the central area to define a first pocket and a second pocket, each having a depth and wherein the maximum elasticity is less than the depth.

11. The apparatus of claim 6 wherein the crib mattress comprises a first three-dimensional section and a second three-dimensional section coupled together along a fold line.

12. The apparatus of claim 11 wherein the sheet envelops substantially all of the first three-dimensional section and second three-dimensional section.

13. The apparatus of claim 11 wherein each three-dimensional section is semi-cylindrical.

14. The apparatus of claim 11 wherein each three-dimensional section is a rectangular solid.

15. The apparatus of claim 7 wherein the substantial portion is greater than 40% of an area of the bottom of the mattress.

16. The apparatus of claim 6 wherein the mattress and sheet are sized such that the mattress has the same shape with the sheet installed as it has without the sheet installed.

17. The apparatus of claim 6 wherein the sheet has a bottom opening which allows the installation and removal of the sheet from the mattress without destroying the sheet.

* * * * *